US009278822B2

(12) United States Patent
Suganuma

(10) Patent No.: US 9,278,822 B2
(45) Date of Patent: Mar. 8, 2016

(54) SHEET SEPARATOR AND IMAGE READER HAVING THE SAME

(71) Applicant: BROTHER KOGYO KABUSHIKI KAISHA, Nagoya-shi, Aichi-ken (JP)

(72) Inventor: Tsuyoshi Suganuma, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/583,290

(22) Filed: Dec. 26, 2014

(65) Prior Publication Data

US 2015/0183600 A1 Jul. 2, 2015

(30) Foreign Application Priority Data

Dec. 27, 2013 (JP) ..... 2013-270687

(51) Int. Cl.

| | |
|---|---|
| ***B65H 1/04*** | (2006.01) |
| ***B65H 3/42*** | (2006.01) |
| ***B65H 3/06*** | (2006.01) |
| ***B65H 5/06*** | (2006.01) |

(52) U.S. Cl.
CPC .. *B65H 3/42* (2013.01); *B65H 1/04* (2013.01); *B65H 3/06* (2013.01); *B65H 5/068* (2013.01)

(58) Field of Classification Search
CPC ..... B65H 1/025; B65H 1/14; B65H 1/18
See application file for complete search history.

(56) References Cited

U.S. PATENT DOCUMENTS

| | | | | |
|---|---|---|---|---|
| 8,496,241 | B2 * | 7/2013 | Osakabe et al. | 271/121 |
| 2003/0062668 | A1 * | 4/2003 | Shibata et al. | 271/121 |
| 2008/0309000 | A1 * | 12/2008 | Tu et al. | 271/109 |
| 2010/0258407 | A1 * | 10/2010 | Krause et al. | 198/443 |
| 2011/0074087 | A1 | 3/2011 | Akimatsu | |
| 2012/0080836 | A1 * | 4/2012 | Morisaki | 271/121 |
| 2012/0126476 | A1 * | 5/2012 | Sheng | 271/121 |
| 2012/0292846 | A1 * | 11/2012 | Kotaka | 271/10.09 |

FOREIGN PATENT DOCUMENTS

| | | | | |
|---|---|---|---|---|
| JP | 06144618 A | * | 5/1994 | B65H 3/52 |
| JP | 2011-073814 A | | 4/2011 | |
| JP | 2012-071946 A | | 4/2012 | |

* cited by examiner

*Primary Examiner* — Jeremy R Severson
(74) *Attorney, Agent, or Firm* — Merchant & Gould P.C.

(57) ABSTRACT

A sheet separator including a separation roller and a separation pad having a separation surface facing an outer circumferential surface of the separation roller in a nip position between the separation surface and the outer circumferential surface, the separation surface including a first surface disposed upstream relative to the nip position in a first direction perpendicular to the axis, the first surface including a curved surface that is curved to become closer to the axis in a direction toward the nip position from an upstream end portion of the separation surface in the first direction, and a second surface disposed downstream relative to the nip position in the first direction, the second surface flatly extending along a second direction parallel to the axis.

16 Claims, 7 Drawing Sheets

SHEET SEPARATOR AND IMAGE READER HAVING THE SAME

CROSS-REFERENCE TO RELATED APPLICATION

This application claims priority under 35 U.S.C. §119 from Japanese Patent Application No. 2013-270687 filed on Dec. 27, 2013. The entire subject matter of the application is incorporated herein by reference.

BACKGROUND

1. Technical Field

The following description relates to aspects of a sheet separator and an image reader having the sheet separator.

2. Related Art

A sheet separator has been known that includes a separation roller and a separation pad. The separation roller is configured to rotate around an axis, and convey sheets downstream in a conveyance direction perpendicular to the axis, by bringing an outer circumferential surface of the separation roller into contact with the sheets. The separation pad has a separation surface that faces the outer circumferential surface of the separation roller. The separation pad is configured to separate the sheets on a sheet-by-sheet basis in cooperation with the separation roller.

In the known sheet separator, the separation surface flatly extends, along the conveyance direction, downstream from an upstream side relative to a nip position in the conveyance direction. It is noted that the nip position is a position where the sheets are pinched between the outer circumferential surface of the separation roller and the separation surface of the separation pad.

SUMMARY

In the known sheet separator, as a larger number of sheets are stacked and set on the upstream side in the conveyance direction, it might be more difficult to properly separate the sheets.

Namely, when a small number of sheets are set, a trajectory drawn by a leading end of a top sheet of the set sheets that is fed to the separation roller intersects the flat separation surface at a small angle. Therefore, the leading end of the top sheet easily reaches the nip position while lightly touching the separation surface. Meanwhile, when a large number of sheets are set, a trajectory drawn by the leading end of the top sheet being fed to the separation roller intersects the flat separation surface at a large angle. Therefore, the leading end of the top sheet is likely to collide against the separation surface in advance of the leading end of the top sheet reaching the nip position. Thus, it might cause such a problem that the leading end of the sheet is bent by the collision.

Aspects of the present disclosure are advantageous to provide one or more improved techniques, for a sheet separator, which make it possible to properly separate sheets regardless of the number of set sheets.

According to aspects of the present disclosure, a sheet separator is provided, which includes a separation roller configured to rotate around an axis, and convey one or more sheets downstream in a first direction perpendicular to the axis, and a separation pad including a separation surface that faces an outer circumferential surface of the separation roller in a nip position between the separation surface and the outer circumferential surface, the separation pad being configured to separate the one or more sheets on a sheet-by-sheet basis in cooperation with the separation roller, the separation surface including a first surface disposed upstream relative to the nip position in the first direction, the first surface including a curved surface that is curved to become closer to the axis in a direction toward the nip position from an upstream end portion of the separation surface in the first direction, and a second surface disposed downstream relative to the nip position in the first direction, the second surface flatly extending along a second direction parallel to the axis.

According to aspects of the present disclosure, further provided is an image reader including a supply tray configured to support one or more sheets placed thereon, an image reading unit configured to read images of the one or more sheets fed from the supply tray, a separation roller configured to rotate around an axis, and convey the one or more sheets downstream in a first direction perpendicular to the axis, toward the image reading unit, and a separation pad including a separation surface that faces an outer circumferential surface of the separation roller in a nip position between the separation surface and the outer circumferential surface, the separation pad being configured to separate the one or more sheets on a sheet-by-sheet basis in cooperation with the separation roller, the separation surface including a first surface disposed upstream relative to the nip position in the first direction, the first surface including a curved surface that is curved to become closer to the axis in a direction toward the nip position from an upstream end portion of the separation surface in the first direction, and a second surface disposed downstream relative to the nip position in the first direction, the second surface flatly extending along a second direction parallel to the axis.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an illustrative embodiment according to aspects of the present disclosure will be described with reference to the accompanying drawings.

Illustrative Embodiment

Figure 1:
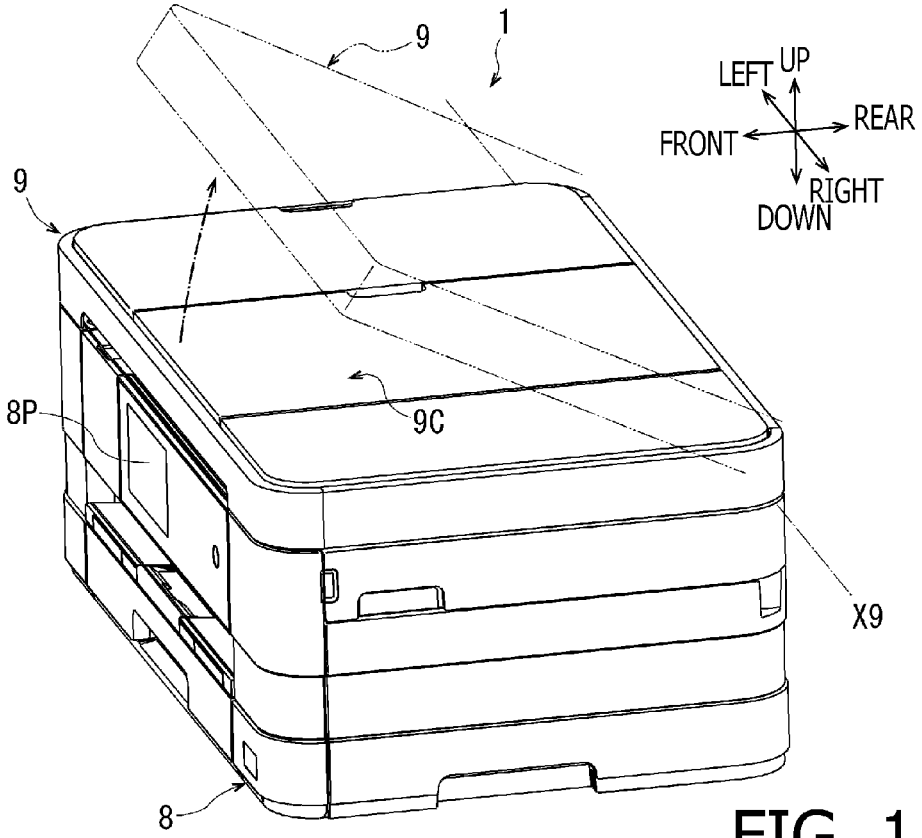
FIG. 1 is a perspective view of an image reader in an illustrative embodiment according to one or more aspects of the present disclosure.

In an image reader 1 of an illustrative embodiment, a front-to-rear direction, a left-to-right direction, and a vertical direction of the image reader 1 will be defined as shown in FIG. 1. For instance, a front side of the image reader 1 is defined as a side where an operation panel 8P is disposed. A left side of the image reader 1 is defined as a left-hand side in a front view (i.e., when a viewer faces the operation panel 8P). The same applies to the other drawings.

<Configuration>

Figure 2:
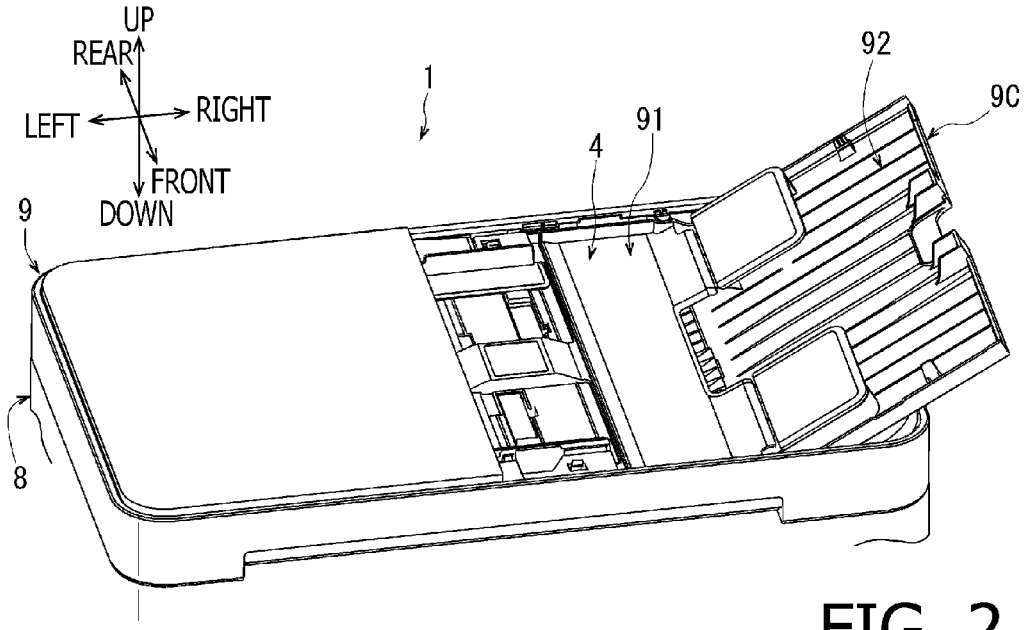
FIG. 2 is a perspective view showing a part of the image reader in the illustrative embodiment according to one or more aspects of the present disclosure.
Figure 3:
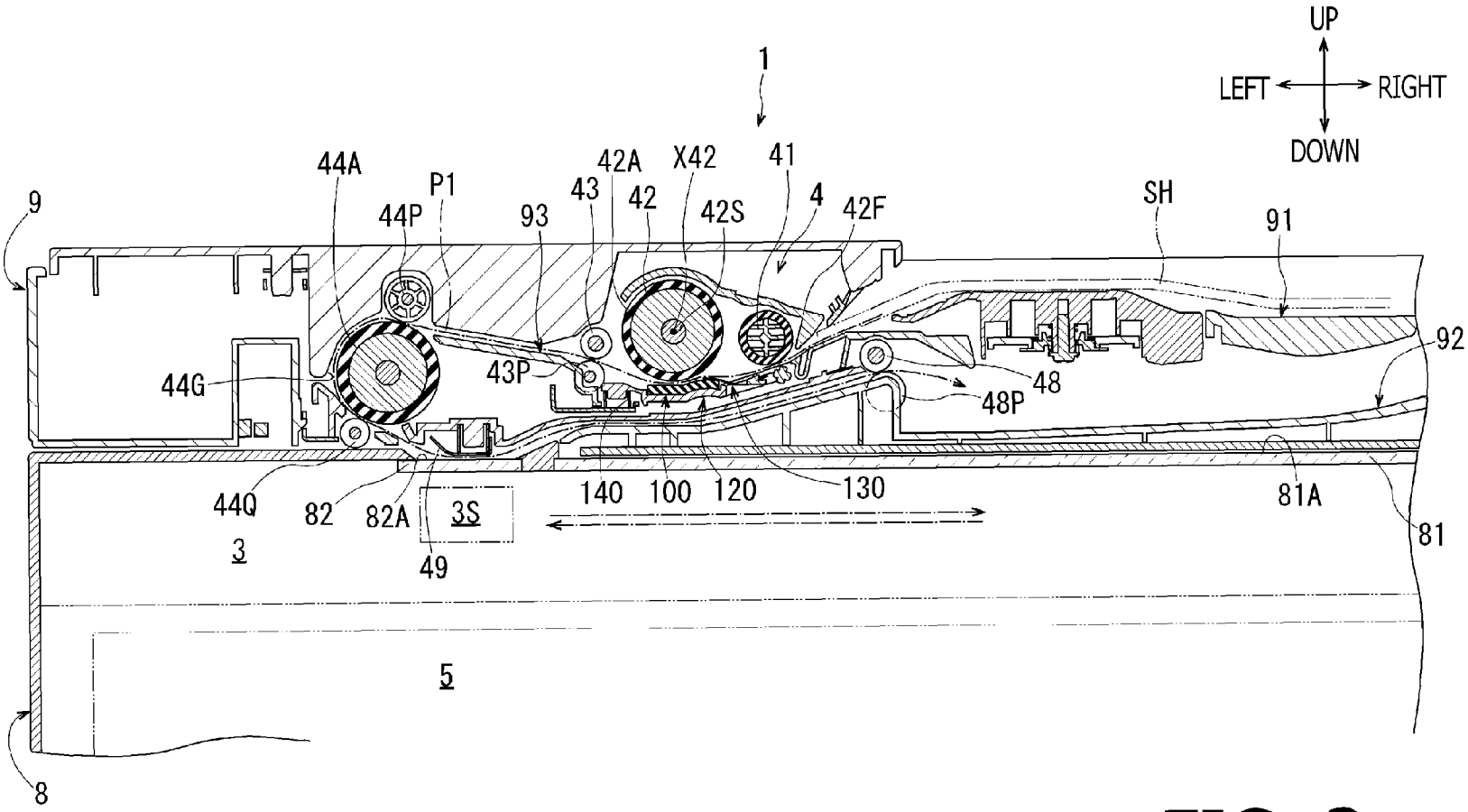
FIG. 3 is a cross-sectional front view showing a part of the image reader in the illustrative embodiment according to one or more aspects of the present disclosure.

As shown in FIGS. 1 to 3, the image reader 1 includes a main body 8, an opening-closing member 9, a reading unit 3, a conveyor 4, and an image forming unit 5. The main body 8 is formed substantially in a flattened box shape. As shown in FIG. 1, on a front surface of the main body 8, an operation panel 8P (such as a touch panel) is disposed.

As shown in FIG. 3, the image forming unit 5 is disposed on a lower side inside the main body 8. The image forming unit 5 is configured to perform image formation in an inkjet method or a laser method, although it is not shown in any drawings.

On an upper surface 8C of the main body 8, a first platen glass 81 and a second platen glass 82 are disposed. An upper surface of the first platen glass 81 forms a document supporting surface 81A. The document supporting surface 81A is configured to support a document to be read from beneath when the reading unit 3 reads an image of the document in a static state. The document to be read may include a paper, a transparency (an OHP sheet), and a book. The second platen glass 82 is disposed on a left side relative to the first platen glass 81. The second platen glass 82 is elongated to extend in the front-to-rear direction. An upper surface of the second platen glass 82 forms a reading surface 82A. The reading surface 82A is configured to guide one or more sheets SH from beneath when the reading unit 3 reads images of the one or more sheets SH being conveyed on a sheet-by-sheet basis by the conveyor 4.

As shown in FIG. 1, the opening-closing member 9 is supported by hinges (not shown) disposed at an upper end portion of a rear surface side of the main body 8, so as to be rotatable around an opening-closing axis X9 extending in the left-to-right direction. As indicated by a solid line in FIG. 1, when closed, the opening-closing member 9 covers the document supporting surface 81A from above. As indicated by an alternate long and two short dashes line in FIG. 1, the opening-closing member 9 swings around the opening-closing axis X9 such that a front end portion of the opening-closing member 9 moves toward an upper rear side. Thereby, the document supporting surface 81A is exposed. Thus, a user is allowed to put a document to be read onto the document supporting surface 81A.

As shown in FIG. 3, the reading unit 3 is disposed on an upper side inside the main body 8. The reading unit 3 includes a reading sensor 3S and a scanning mechanism (not shown). The reading sensor 3S is disposed below the document supporting surface 81A and the reading surface 82A. The scanning mechanism is configured to reciprocate the reading sensor 3S along the left-to-right direction inside the main body 8. As the reading sensor 3S, a known image sensor may be used such as a contact image sensor (hereinafter referred to as a CIS) or a charge coupled device (hereinafter referred to as a CCD).

When the reading unit 3 reads an image of a document supported on the document supporting surface 81A, the reading sensor 3S is moved, by the scanning mechanism (not shown), along the left-to-right direction between a position under a left end portion of the document supporting surface 81A and a position under a right end portion of the document supporting surface 81A. Further, when the reading unit 3 reads images of sheets SH being conveyed on a sheet-by-sheet basis by the conveyor 4, the reading sensor 3S is caused, by the scanning mechanism (not shown), to stop in a predetermined reading position under the reading surface 82A.

As shown in FIGS. 2 and 3, the conveyor 4 is disposed at the opening-closing member 9. The conveyor 4 includes a supply tray 91 and a discharge tray 92. The supply tray 91 and the discharge tray 92 are positioned on a right side relative to the opening-closing member 9, when a cover 9C closed as shown in FIG. 1 is opened as shown in FIG. 2. The discharge tray 92 is disposed below the supply tray 91. The supply tray 91 is configured to support, from beneath, sheets to be conveyed by the conveyor 4. The discharge tray 92 is configured to support one or more sheets discharged by the conveyor 4 after images of the one or more sheets have been read by the reading unit 3.

As shown in FIG. 3, the conveyor 4 includes a conveyance path P1 defined as a space surrounded by guide surfaces, which extend to be able to contact one side and the other side of a sheet inside the opening-closing member 9. First, the conveyance path P1 includes a portion extending leftward from the supply tray 91 in a substantially horizontal direction. Next, the conveyance path P1 includes a portion U-turning downward. Subsequently, the conveyance path P1 includes a portion extending short toward the right along the reading surface 82A. Finally, the conveyance path P1 includes an obliquely-ascending portion that is slanted upward (relative to a horizontal plane) in a rightward direction and leads to the discharge tray 92.

On the upper portion of the conveyance path P1 that extends in a substantially horizontal direction, the conveyance direction of the sheets SH conveyed by the conveyor 4 is the leftward direction. On the downward U-turning portion of the conveyance path P1, the conveyance direction of the sheets SH changes from the leftward direction to the rightward direction. On the lower portion of the conveyance path P1 that passes over the reading surface 82A and leads to the discharge tray 92, the conveyance direction of the sheets SH is the rightward direction.

As shown in FIGS. 3 to 9, the conveyor 4 includes a chute member 93, a pickup roller 41, a separation roller 42, a separation pad 100, a supporter 120, a compression coil spring 140, a film 130, and two leaf springs 150 (i.e., a front leaf spring 150 and a rear leaf spring 150).

Figure 4:
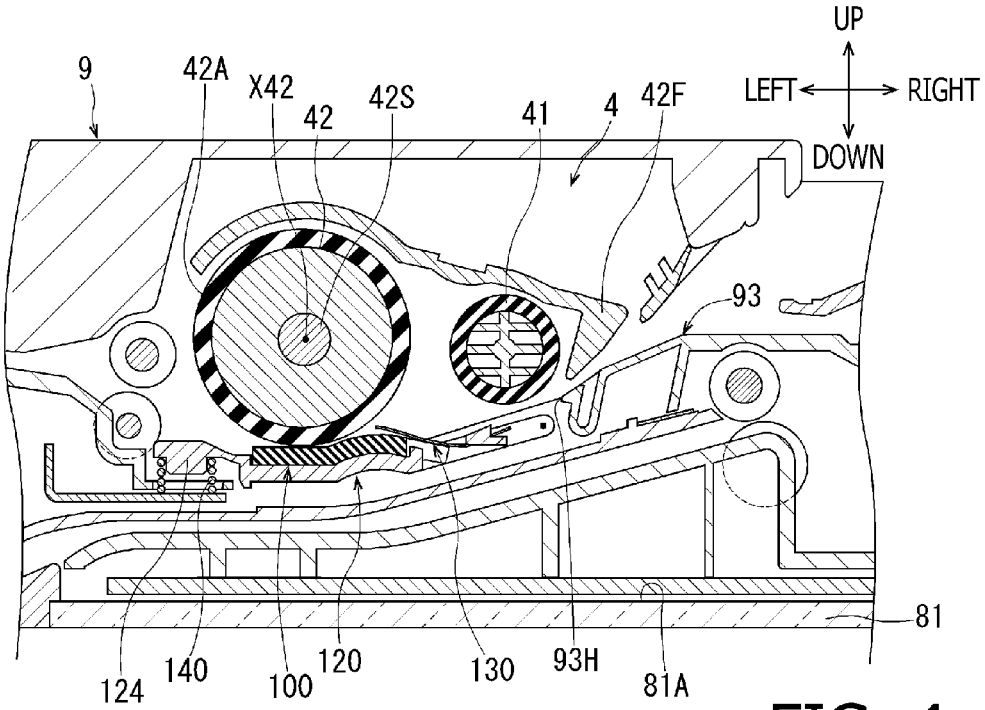
FIG. 4 is a cross-sectional front view showing a part of the image reader in an enlarged manner, in the illustrative embodiment according to one or more aspects of the present disclosure.
Figure 6:
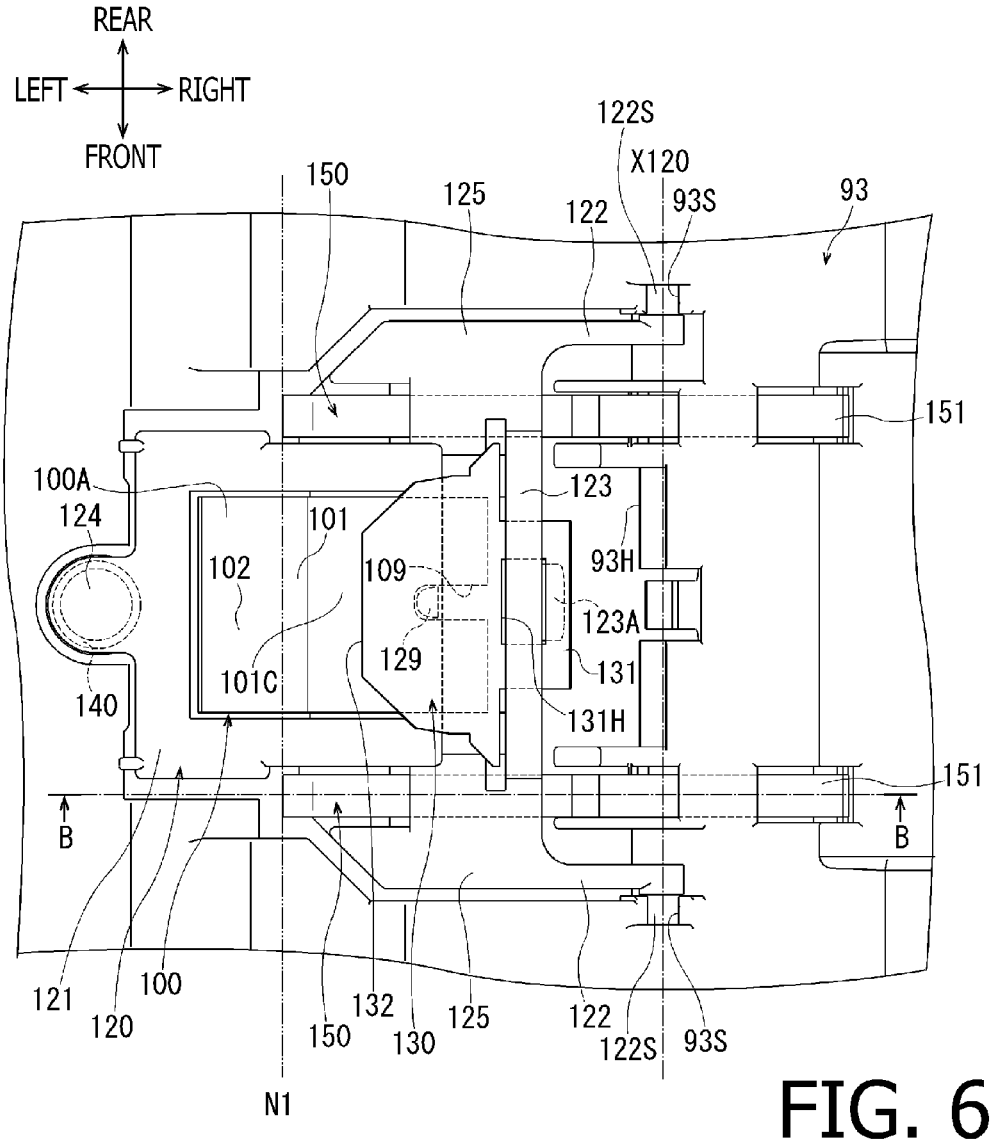
FIG. 6 is a plane view showing the separation pad, a supporter, a film, and leaf springs of the image reader in the illustrative embodiment according to one or more aspects of the present disclosure.

As shown in FIGS. 3, 4, and 6, the chute member 93 is a resin molded body formed substantially in a flat plate shape. The chute member 93 is connected with a left end portion of the supply tray 91, and further extends leftward therefrom. An upper surface of the chute member 93 is a guide surface that defines a lower part of the substantially-horizontal upper portion of the conveyance path P1.

As shown in FIGS. 3 and 4, the pickup roller 41 and the separation roller 42 are disposed to face the chute member 93 from above. The separation roller 42 is attached to a drive shaft 42S having an axis X42 as a central axis extending in the front-to-rear direction. The separation roller 42 is configured to rotate around the axis X42, integrally with the drive shaft 42S. The separation roller 42 has an outer circumferential surface 42A that is a cylindrical circumference with the axis X42 (the drive shaft 42S) as a central axis. The outer circumferential surface 42A is formed as a surface of an elastic rubber layer formed on an outer circumferential side of the separation roller 42.

The separation roller 42 is configured to rotate while bringing the outer circumferential surface 42A into contact with a sheet SH fed from the supply tray 91 (i.e., from an upstream side relative to the separation roller 42 in the conveyance direction), and convey the sheet SH leftward (i.e., downstream in the conveyance direction) along the substantially-horizontal upper portion of the conveyance path P1.

In the substantially-horizontal upper portion of the conveyance path P1, the direction leftward from the right, which is the conveyance direction of the sheet SH, intersects perpendicularly with the axis X42 extending in the front-to-rear direction.

By the drive shaft 42S, a holder 42F is swingably supported. The holder 42F protrudes rightward from the drive shaft 42S. The pickup roller 41 is rotatably supported by a right portion of the holder 42F. The holder 42F is provided with a transmission gear group (not shown) configured to transmit a rotational driving force from the drive shaft 42S to the pickup roller 41.

Figure 5:
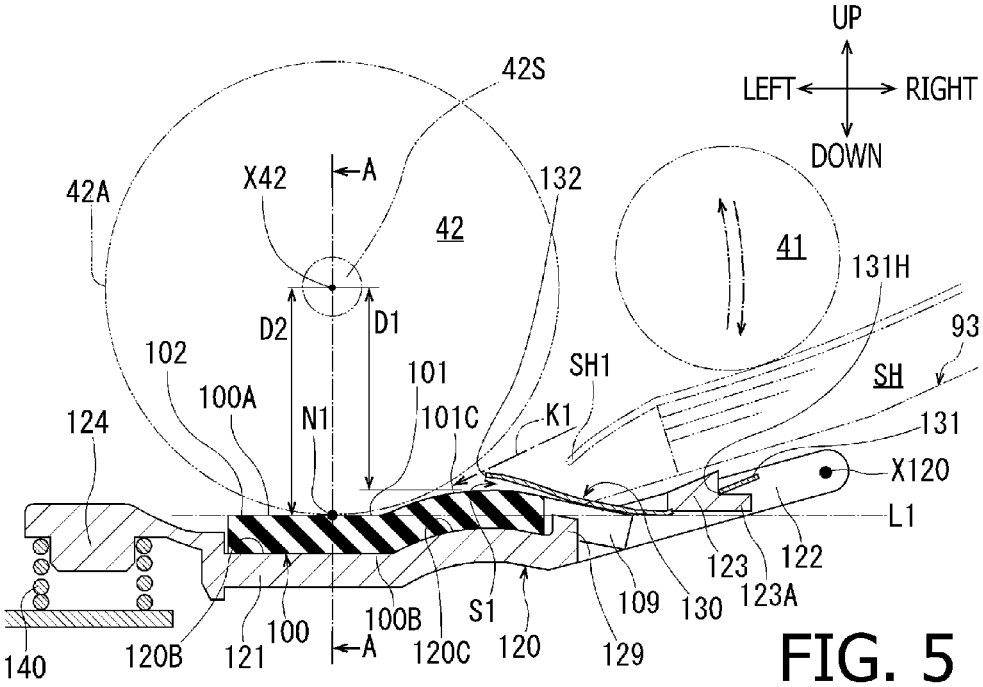
FIG. 5 is a cross-sectional front view schematically showing a separation roller and a separation pad of the image reader in the illustrative embodiment according to one or more aspects of the present disclosure.

As shown in FIG. 5, when sheets SH are set on the supply tray 91, leading ends of the sheets SH are vertically pinched between the chute member 93 and the pickup roller 41. Further, an end portion of the chute member 93 on a side close to the supply tray 91 is slanted downward in a direction toward a downstream side in the conveyance direction (i.e., toward the pickup roller 41, and is formed such that the sheets SH set on the supply tray 91 are guided toward the pickup roller 41. When the holder 42F swings around the drive shaft 42S, the pickup roller 41 is allowed to become closer to and farther away from the chute member 93 in the vertical direction. Therefore, as there are a large number of sheets SH stacked on the supply tray 91, the pickup roller 41 is spaced apart from the chute member 93 and contacts a top one of the sheets SH from above. Meanwhile, as there are a small number of sheets SH stacked on the supply tray 91, the pickup roller 41 is positioned close to the chute member 93 and contacts a top one of the sheets SH from above.

The pickup roller 41 rotates around an axis parallel to the axis X42 of the separation roller 42, provides a conveyance force to the top sheet SH of the sheets SH supported on the supply tray 91, and conveys the top sheet SH toward the separation roller 42.

As shown in FIGS. 3 to 7, the separation pad 100 is disposed in such a position, on a side close to the chute member 93, as to face the separation roller 42 from beneath. The separation pad 100 is a plate-shaped member with a constant thickness, and is made of soft material such as rubber and elastomer. As indicated by an alternate long and two short dashes line in FIG. 7, the separation pad 100 is, for instance, cut out of a large plate-shaped material with a constant thickness by punching.

Figure 7:
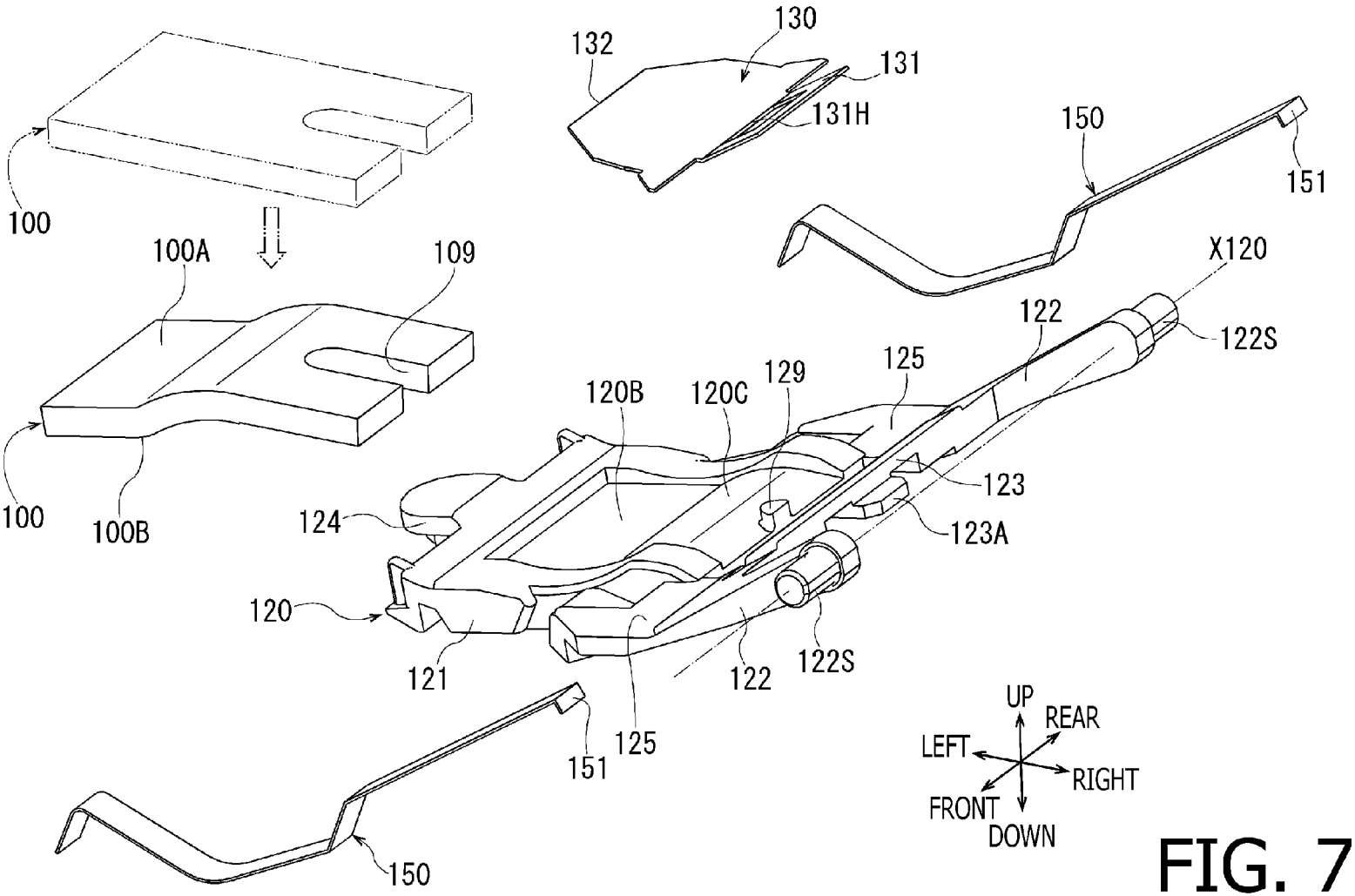
FIG. 7 is an exploded perspective view showing the separation pad, the supporter, the film, and the leaf springs of the image reader in the illustrative embodiment according to one or more aspects of the present disclosure.

As shown in FIGS. 5 to 7, the separation pad 100 has a separation surface 100A and a bonded surface 100B. The separation surface 100A is an upward-facing surface opposed to the outer circumferential surface 42A of the separation roller 42. The bonded surface 100B is a downward-facing surface.

The separation pad 100 has a positioning groove 109. The positioning groove 109 is formed at a middle portion of the separation pad 100 in the front-to-rear direction. The positioning groove 109 is a cutout groove recessed leftward from a right end of the separation pad 100.

As shown in FIGS. 4 and 6, the chute member 93 has an opening 93H. The opening 93H is formed by cutting out of the chute member 93, a portion positioned on a lower side relative to the separation roller 42. As shown in FIG. 6, at a right front corner portion and a right rear corner portion of the opening 93H, two bearings 93S (i.e., a front bearing 93S and a rear bearing 93S) are disposed in a recessed manner, respectively.

As shown in FIGS. 5 to 7, the supporter 120 is a resin molded body that includes a base 121, two plate-shaped portions 125 (i.e., a front plate-shaped portion 125 and a rear plate-shaped portion 125), and two protrusions 122 (i.e., a front protrusion 122 and a rear protrusion 122).

The base 121 is formed substantially in a rectangular plate shape. On an upper surface of the base 121, a supporting surface 120B is formed. The supporting surface 120B is a bottom surface of a concave portion shallowly recessed from an uppermost surface of the base 121. A left portion of the supporting surface 120B forms a flat surface along the front-to-rear direction and the left-to-right direction. A right portion 120C of the supporting surface 120B forms an upward-bulging curved surface. At a right end portion of the supporting surface 120B, a positioning projection 129 is formed. The positioning projection 129 protrudes upward in a column shape.

At a left end portion of the base 121, a spring receiver 124 is formed. The spring receiver 124 is a small piece that protrudes leftward from a left end of a substantially-horizontal portion of the base 121. On a lower surface of the spring receiver 124, a boss is formed to protrude downward.

As shown in FIGS. 6 and 7, the front plate-shaped portion 125 and the rear plate-shaped portion 125 extend substantially in plate shape from a front end portion and a rear end portion of the base 121, respectively. The right portion 120C of the supporting surface 120B is sandwiched between the front plate-shaped portion 125 and the rear plate-shaped portion 125 in the front-to-rear direction.

Each protrusion 122 protrudes rightward from a corresponding one of the plate-shaped portions 125. There are two shaft portions 122S (i.e., a front shaft portion 122S and a rear shaft portion 122S) formed at respective right end portions of the protrusions 122. Each shaft portion 122S is a cylindrical shaft body with a swing axis X120 as a central axis. The swing axis X120 extends in the front-to-rear direction. The front shaft portion 122S and the rear shaft portion 122S protrude in such directions as to become farther away from each other, respectively.

As shown in FIGS. 5 to 7, each plate-shaped portion 125 is connected with a film holder 123, on a right side relative to the positioning projection 129. The film holder 123 extends in the front-to-rear direction, in a position where the film holder 123 is spaced apart from a right end portion of the supporting surface 120B (the right portion 120C). The film holder 123 has a convex portion 123A formed to protrude rightward from a middle portion of the film holder 123 in the front-to-rear direction.

As shown in FIG. 6, when each shaft portion 122S of the supporter 120 is fitted into a corresponding one of the bearings 93S of the chute member 93, the supporter 120 is supported by the chute member 93 to be swingable around the swing axis X120.

As shown in FIG. 5, the supporting surface 120B of the supporter 120 is bonded with the bonded surface 100B of the separation pad 100 via a double-sided adhesive tape or adhesive material. At this time, the positioning projection 129 protrudes into the positioning groove 109, and the separation pad 100 is positioned relative to the supporting surface 120B. Thereby, the supporter 120 supports the separation pad 100.

As indicated by a solid line in FIG. 7, the separation pad 100, which is made of soft material, is likely to be easily deformed along a curved surface. Therefore, when bonded with the supporting surface 120B, the separation pad 100 is deformed along the right portion 120C of the supporting surface 120B. Consequently, as shown in FIG. 5, a right portion of the separation pad 100 is curved to bulge upward along a curved shape of the right portion 120C of the supporting surface 120B.

As shown in FIGS. 4 to 6, an upper end portion of the compression coil spring 140 engages with the spring receiver 124 of the supporter 120. Further, a lower end portion of the compression coil spring 140 engages with an inner frame of the opening-closing member 9. Thereby, the compression coil spring 140 urges the separation pad 100 via the supporter 120 in such a direction that the separation surface 100A of the separation pad 100 approaches the outer circumferential surface 42A of the separation roller 42.

As shown in FIG. 6, in a plane view, the compression coil spring 140 is spaced apart leftward from the separation pad 100. Namely, when viewed in the vertical direction perpendicular to the conveyance direction and a width direction, the compression coil spring 140 is disposed in such a position as not to overlap the separation pad 100.

Figure 8:
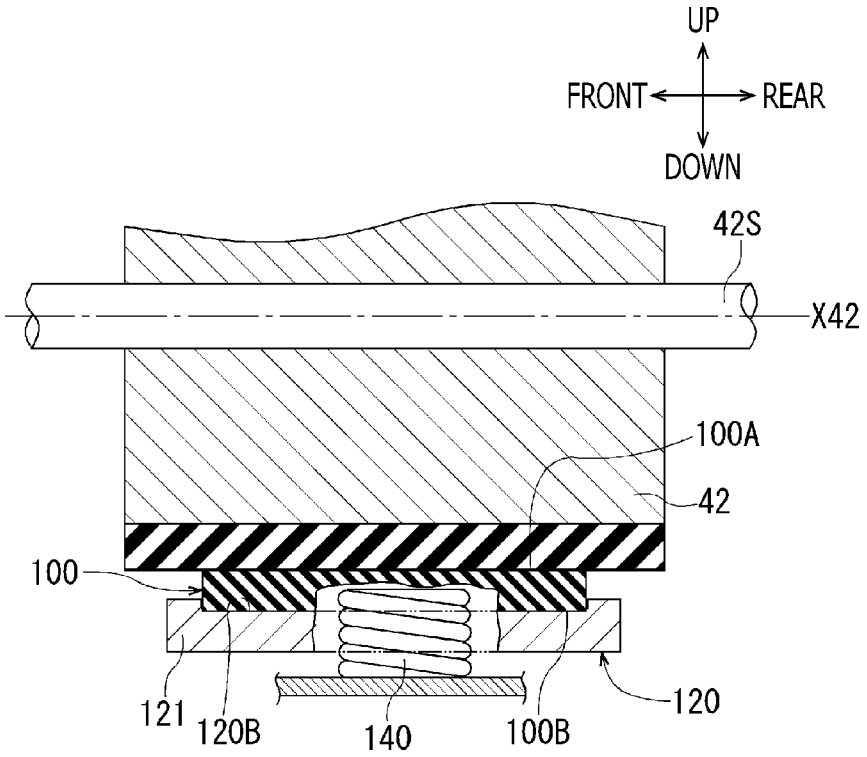
FIG. 8 is a cross-sectional side view taken along an A-A line shown in FIG. 5, in the illustrative embodiment according to one or more aspects of the present disclosure.

As shown in FIG. 8, when viewed in the left-to-right direction as the conveyance direction, an upper end part of the compression coil spring 140 overlaps the separation pad 100.

As shown in FIGS. 5 and 6, a nip position N1 is defined as a position where a sheet SH is pinched between the outer circumferential surface 42A of the separation roller 42 and the separation surface 100A of the separation pad 100 when the sheet SH is fed from the supply tray 91. Of the separation surface 100A, a first surface 101 and a second surface 102 are defined on the basis of their positions relative to the nip position N1. Specifically, the first surface 101 of the separation surface 100A is positioned upstream relative to the nip position N1 in the conveyance direction. The second surface 102 of the separation surface 100A is positioned downstream relative to the nip position N1 in the conveyance direction. The first surface 101 includes a curved surface 101C. The curved surface 101C is curved to become closer to the outer circumferential surface 42A of the separation roller 42 (closer to the axis X42) in a direction toward the nip position N1 from a right end portion of the separation surface 100A (from the upstream side in the conveyance direction). The second surface 102 flatly extends along the front-to-rear direction as the width direction and the left-to-right direction as the conveyance direction.

As shown in FIG. 5, a nip tangent L1 is defined as a tangential line that extends in the conveyance direction to be tangent to the outer circumferential surface 42A in the nip position N1. Toward a downstream side in the conveyance direction, the curved surface 101C is curved and brought into closest proximity to the outer circumferential surface 42A, on a side closer to the axis X42 than the nip tangent L1. Thereafter, the curved surface 101 is slightly away from the outer circumferential surface 42A while maintaining the curved shape, and then ends in a position to intersect the nip tangent L1. The second surface 102 is positioned lower than a top portion of the curved surface 101. The second surface 102 extends in the left-to-right direction, along the nip tangent L1. A vertical distance D2 between the axis X42 of the separation roller 42 and the second surface 102 is longer than a vertical distance D1 between the axis X42 of the separation roller 42 and the top portion of the curved surface 101C. Namely, in the vertical direction, the second surface 102 is farther away from the axis X42 of the separation roller 42 than the top portion of the curved surface 101C. Between the curved surface 101C and the second surface 102, the first surface 101 extends in the left-to-right direction, along the nip tangent L1, and forms a flat surface continuous with the second surface 102.

The right portion 120C of the supporting surface 120B of the supporter 120 extends substantially within a range corresponding to the curved surface 101C. Namely, the right portion 120C of the supporting surface 120B is curved to become closer to the axis X42 toward the nip position N1 from the upstream side in the conveyance direction. Thereby, it is possible to form, as the curved surface 101C, a portion of the separation pad 100 that closely adheres to the right portion 120C of the supporting surface 120B.

The separation pad 100 configured as above separates the sheets SH fed from the supply tray 91 and passing through the nip position N1, on a sheet-by-sheet basis in cooperation with the separation roller 42.

As shown in FIGS. 5 to 7, the film 130 is a thin resin member. The film 130 is formed, for instance, by punching a polyester film.

As shown in FIG. 7, at a first end portion 131 as a right part of the film 130, an engagement hole 131H is formed. Into the engagement hole 131H, the convex portion 123A formed at the film holder 123 is inserted. Namely, the first end portion 131 of the film 130 is disposed upstream relative to the curved surface 101C in the conveyance direction.

As shown in FIGS. 5 and 6, the film 130 extends leftward (i.e., downstream in the conveyance direction) from the first end portion 131, and passes under the film holder 123. Thereafter, the film 130 extends higher than the upper surface of the supporter 120, and further extends downstream in the conveyance direction. A second end portion 132 as a downstream end portion of the film 130 in the conveyance direction reaches the curved surface 101C. More specifically, the second end portion 132 of the film 130 reaches a position of the curved surface 101C in the conveyance direction. The second end portion 132 of the film 130 is positioned above the curved surface 101C. As shown in FIG. 5, the second end portion 132 extends along the curved surface 101C with a gap S1 therebetween, and approaches the outer circumferential surface 42A of the separation roller 42. In other words, the second end portion 132 is spaced apart from the curved surface 101C in the vertical direction.

Figure 9:
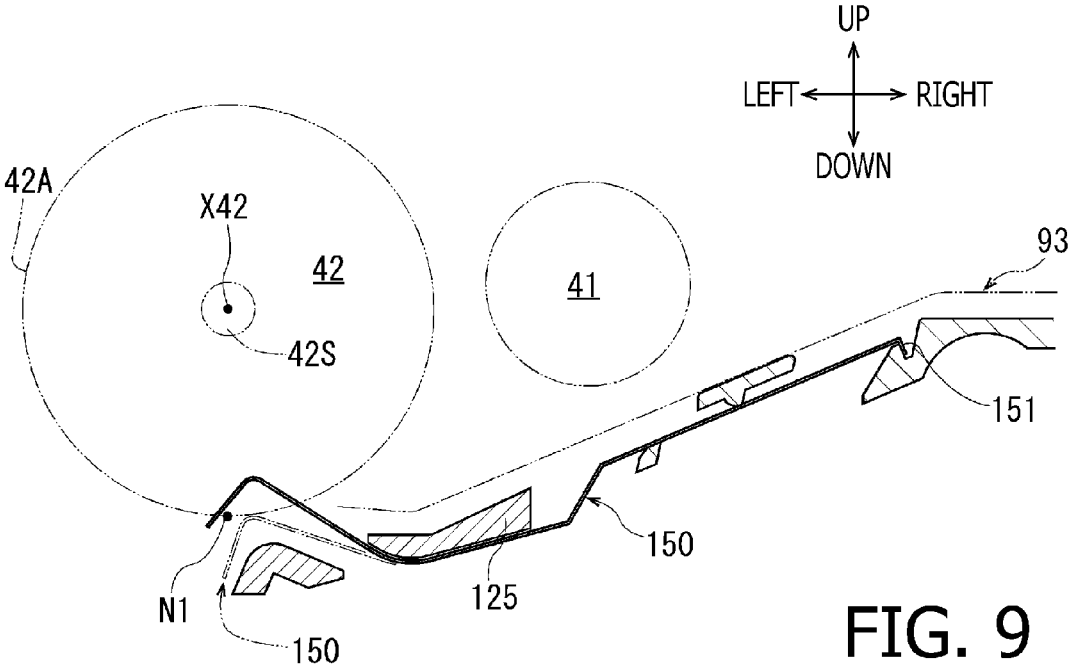
FIG. 9 is a cross-sectional front view taken along a B-B line shown in FIG. 6, in the illustrative embodiment according to one or more aspects of the present disclosure.

As shown in FIGS. 6, 7, and 9, each leaf spring 150 is made of a spring steel sheet and elongated in the left-to-right direction. A right end portion 151 of each leaf spring 150 is fixedly attached to the chute member 93, on a right side relative to the bearings 93S. Namely, the right end portion 151 of each leaf spring 150 is disposed upstream relative to the curved surface 101C in the conveyance direction. Each leaf spring 150 extends leftward (i.e., downstream in the conveyance direction) from the right end portion 151.

As shown in FIGS. 6 and 9, each plate-shaped portion 125 is disposed upstream relative to the nip position N1 in the conveyance direction.

As shown in FIGS. 7 and 9, each leaf spring 150 extends leftward along a downward-facing surface of a corresponding one of the plate-shaped portions 125, and thereafter bends upward. Then, each leaf spring 150 protrudes toward the outer circumferential surface 42A from each plate-shaped portion 125, and approaches the outer circumferential surface 42A near the nip position N1. As indicated by an alternate long and two short dashes line in FIG. 9, each leaf spring 150, in a state after completion of a product, is elastically deformed and brought into contact with the outer circumferential surface 42A of the separation roller 42, near the nip position N1.

As shown in FIG. 3, the conveyor 4 includes a feed roller 43 and a pinch roller 43P disposed in respective positions, along the conveyance path P1, downstream relative to the separation roller 42 and the separation pad 100 in the conveyance direction. The feed roller 43 and the pinch roller 43P are configured to convey, downstream in the conveyance direction, the sheets SH separated on a sheet-by-sheet basis by the separation roller 42 and the separation pad 100.

The conveyor 4 includes a conveyance roller 44A and a curved guide surface 44G disposed along the downward U-turning portion of the conveyance path P1. The conveyance roller 44A forms an inner guide surface of the downward U-turning portion of the conveyance path P1. The curved guide surface 44G forms an outer guide surface of the downward U-turning portion of the conveyance path P1. The conveyance roller 44A is configured to convey the sheets SH to the reading surface 82A in cooperation with pinch rollers 44P and 44Q. The pinch rollers 44P and 44Q are configured to contact the outer circumferential surface of the conveyance roller 44A.

The conveyor 4 includes a pressing member 49 disposed in a position to face the reading surface 82A from above. The pressing member 49 is configured to press a sheet SH from above and bring the sheet SH into contact with the reading surface 82A.

The conveyor 4 includes a discharge roller 48 and a pinch roller 48P disposed in respective positions, along the obliquely-ascending portion of the conveyance path P1, on a right side relative to the pressing member 49. The discharge roller 48 and the pinch roller 48P face the discharge tray 92. The discharge roller 48 and the pinch roller 48P are configured to discharge, onto the discharge tray 92, a sheet SH having passed over the reading surface 82A.

In the image reader 1, when the reading unit 3 reads an image of a document supported on the document supporting surface 81A, the scanning mechanism (not shown) of the reading unit 3 operates and moves the reading sensor 3S along the left-to-right direction between a position under a left end portion of the document supporting surface 81A and a position under a right end portion of the document supporting surface 81A. Thereby, the reading sensor 3S reads the image of the document supported on the document supporting surface 81A. Thereafter, the scanning mechanism (not shown) moves the reading sensor 3S, which has completed the image reading operation, back to an original position on a left side from a right-side position inside the reading unit 3.

Further, in the image reader 1, when the reading unit 3 reads images of sheets placed on the supply tray 91, the scanning mechanism (not shown) of the reading unit 3 operates and stops the reading sensor 3S in a predetermined reading position under the reading surface 82A. Then, when the conveyor 4 sequentially conveys the sheets SH on the supply tray 91 along the conveyance path P1, the sheets SH pass over the reading sensor 3S staying in the predetermined reading position while contacting the reading surface 82A. Thereby, the reading sensor 3S reads the images of the sheets SH passing over the reading sensor 3S. The sheets SH of which the images have been read are discharged onto the discharge tray 92 by the discharge roller 48 and the pinch roller 48P.

<Operations and Advantageous Effects>

In the image reader 1 of the illustrative embodiment, as shown in FIG. 5, the first surface 101 of the separation surface 100A that is positioned closer to the supply tray 91 than the nip position N1 (i.e., upstream relative to the nip position N1 in the conveyance direction) forms the curved surface 101C. The curved surface 101C is curved to become closer to the axis X42 in a direction toward the nip position N1 from the upstream side in the conveyance direction. Therefore, in the image reader 1, regardless of the number of the sheets SH set on the supply tray 91, when a top sheet SH is fed to the separation roller 42, a leading end SH1 of the sheet SH is brought into contact with the curved surface 101C and is guided along the curved surface 101C so as to approach the outer circumferential surface 42A of the separation roller 42 and the nip position N1. Then, a trajectory K1 drawn by the leading end SH1 of the sheet SH being guided along the curved surface 101C makes a change to intersect the flat second surface 102 at a small angle. Therefore, the leading end SH1 of the sheet SH is less likely to collide against the separation surface 100A of the separation pad 100 in advance of reaching the nip position N1. Thus, it is possible to effectively prevent such a problem that the leading end SH1 of the sheet SH is bent.

Further, according to the image reader 1, it is possible to smoothly convey a sheet SH (separated from one or more other sheets SH) downstream in the conveyance direction, along the second surface 102 flatly extending in the front-to-rear direction as the width direction.

Figure 10:
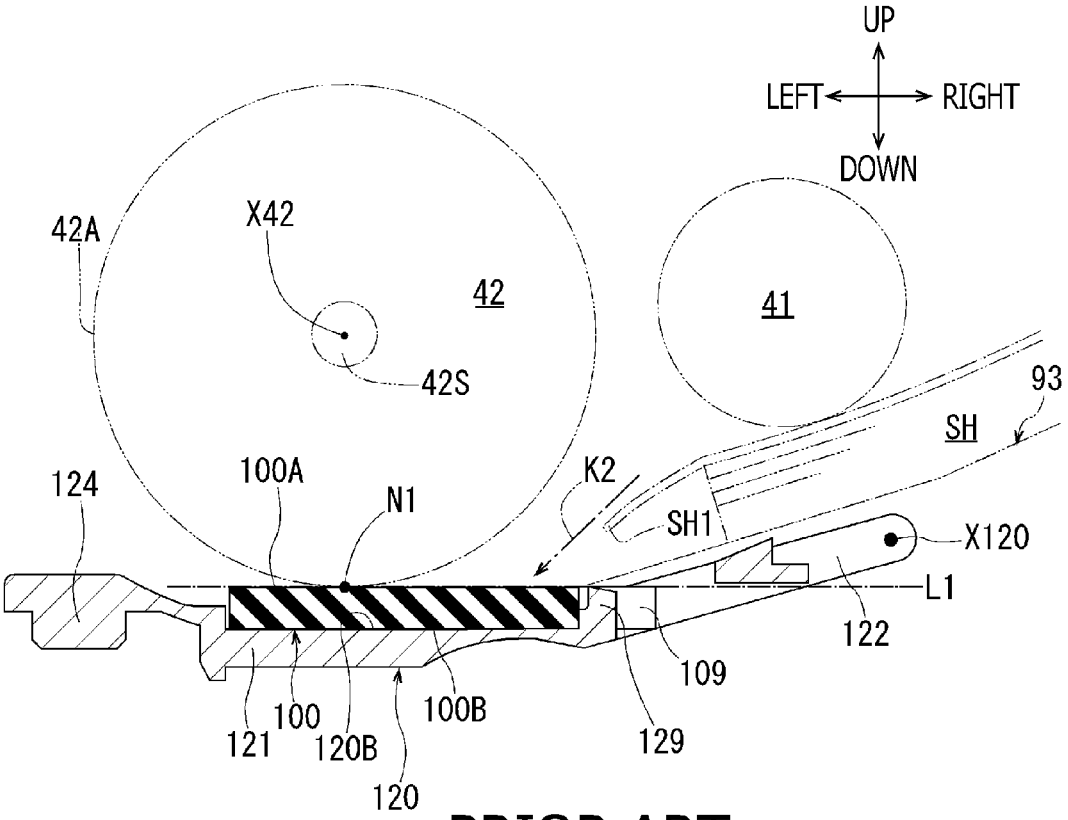
PRIOR ART FIG. 10
FIG. 10 is a cross-sectional front view schematically showing a separation roller and a separation pad of an image reader in a comparative example.

FIG. 10 shows an image reader in a comparative example that does not have an element corresponding to the curved surface 101C of the separation surface 100A of the image reader 1 in the illustrative embodiment. The comparative example is different from the illustrative embodiment in that the separation surface 100A of the separation pad 100 flatly extends along the front-to-rear direction and the nip tangent L1, from the upstream side to the downstream side relative to the nip position N1 in the conveyance direction. In the comparative example, when a large number of sheets SH are set, a trajectory K2 drawn by a leading end SH1 of a top sheet SH being fed to the separation roller 42 intersects the flat separation surface 100A at a large angle. Therefore, the leading end SH1 of the sheet SH is likely to easily collide against the separation surface 100A in advance of reaching the nip position N1. Thus, it might cause such a problem that the leading end SH1 of the sheet SH is bent.

Accordingly, in the image reader 1 of the illustrative embodiment, regardless of the number of sheets SH set on the supply tray 91, it is possible to properly separate the sheets SH.

Further, in the image reader 1, as shown in FIG. 5, the right portion 120C of the supporting surface 120B of the supporter 120 is curved to become closer to the axis X42 in a direction toward the nip position N1 from the upstream side in the conveyance direction. It is noted that the right portion 120C extends substantially within a range corresponding to the curved surface 101C. Thereby, according to the image reader 1, it is possible to easily form the curved surface 101C, by putting the separation pad 100, which is a plate-shaped body with a constant thickness, along the supporting surface 120B of the supporter 120. Further, according to the image reader 1, it is possible to achieve a lower manufacturing cost than when the curved surface 101C is formed by changing the thickness of the separation pad 100 in a method such as cast molding.

Further, in the image reader 1, as shown in FIG. 5, the second end portion 132 as a downstream end portion of the film 130 in the conveyance direction is positioned to reach the position of the curved surface 101C in the conveyance direction. The second end portion 132 extends along the shape of the curved surface 101C with the gap S1 therebetween. Thereby, in the image reader 1, the leading end SH1 of the sheet SH fed by the separation roller 42 slides in contact with the slippery film 130, and is conveyed along the shape of the curved surface 101C to the second end portion 132. Thus, the leading end SH1 of the sheet SH is certainly guided to approach the outer circumferential surface 42A of the separation roller 42 and the nip position N1.

Further, in the image reader 1, as shown in FIG. 6, when viewed in the vertical direction perpendicular to the conveyance direction and the width direction, the compression coil spring 140 is disposed in such a position as not to overlap the separation pad 100. Therefore, according to the image reader 1, it is possible to make a portion around the separation pad 100 thinner in the vertical direction. Further, even though the separation pad 100 having the curved surface 101C is thicker than a known separation pad in the vertical direction, it is possible to prevent enlargement of the image reader 1 in the vertical direction.

Further, in the image reader 1, as shown in FIG. 8, when viewed in the left-to-right direction, an upper end part of the compression coil spring 140 overlaps the separation pad 100. Therefore, according to the image reader 1, it is possible to further make a portion around the separation pad 100 thinner in the vertical direction.

Further, in the image reader 1, by the leaf springs 150 shown in FIGS. 6 and 9, the leading end SH1 of the sheet SH is securely guided to approach the outer circumferential surface 42A of the separation roller 42. Moreover, in the image reader 1, each leaf spring 150 has a portion that extends downstream in the conveyance direction, along the downward-facing surface of a corresponding one of the plate-shaped portions 125. Thereby, it is possible to make the image reader 1 thinner in the vertical direction than when the leaf springs 150 are entirely disposed on an upper-surface side of the plate-shaped portions 125.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein.

What is claimed is:

1. A sheet separator comprising:

a separation roller configured to rotate around an axis, and convey one or more sheets downstream in a first direction perpendicular to the axis;

a separation pad comprising a separation surface that faces an outer circumferential surface of the separation roller in a nip position between the separation surface and the outer circumferential surface, the separation pad being configured to separate the one or more sheets on a sheet-by-sheet basis in cooperation with the separation roller, the separation surface comprising:

a first surface disposed upstream relative to the nip position in the first direction, the first surface comprising a curved surface that is curved to become closer to the axis in a direction toward the nip position from an upstream end portion of the separation surface in the first direction; and a second surface disposed downstream relative to the nip position in the first direction, the second surface flatly extending along a second direction parallel to the axis; and an urging member configured to urge the separation pad in such a direction that the separation surface approaches the outer circumferential surface of the separation roller, the urging member being disposed in such a position as not to overlap the separation pad in a view in a third direction perpendicular to the first direction and the second direction.

2. The sheet separator according to claim 1, wherein the curved surface of the first surface is positioned closer to the axis than the second surface in a third direction perpendicular to the first direction and the second direction.

3. The sheet separator according to claim 1, wherein the first surface and the second surface form a continuous surface, and wherein the second surface extends in a substantially horizontal direction.

4. The sheet separator according to claim 1, further comprising a supporter configured to support the separation pad, wherein the separation pad is a plate-shaped body having a constant thickness, and comprises a bonded surface opposite to the separation surface, and wherein the supporter comprises a supporting surface along which the bonded surface of the separation pad is attached, the supporting surface being curved to become closer to the axis in the direction toward the nip position from an upstream end of the supporting surface in the first direction, within a range corresponding to the curved surface.

5. The sheet separator according to claim 1, further comprising a film extending downstream in the first direction, the film comprising:

an upstream end portion disposed upstream relative to the curved surface in the first direction; and a downstream end portion disposed downstream relative to the upstream end portion in the first direction, the downstream end portion being positioned to reach a position of the curved surface in the first direction.

6. The sheet separator according to claim 5, wherein the downstream end portion of the film is spaced apart from the curved surface in a third direction perpendicular to the first direction and the second direction.

7. The sheet separator according to claim 1, wherein the urging member is disposed in a position where at least a part of the urging member overlaps the separation pad in a view in the first direction.

8. The sheet separator according to claim 1, further comprising:

a supporter configured to support the separation pad, the supporter comprising a plate-shaped portion disposed upstream relative to the nip position in the first direction; and a leaf spring disposed in a position where an end portion of the leaf spring is positioned upstream relative to the curved surface in the first direction, the leaf spring extending downstream in the first direction and approaching the outer circumferential surface of the separation roller near the nip position, the leaf spring being formed to:

extend downstream in the first direction, along a surface of the plate-shaped portion that is opposite to a surface of the plate-shaped portion facing the outer circumferential surface of the separation roller;

thereafter bend; and thereafter protrude toward the outer circumferential surface of the separation roller from the plate-shaped portion.

9. An image reader comprising:

a supply tray configured to support one or more sheets placed thereon;

an image reading unit configured to read images of the one or more sheets fed from the supply tray;

a separation roller configured to rotate around an axis, and convey the one or more sheets downstream in a first direction perpendicular to the axis, toward the image reading unit;

a separation pad comprising a separation surface that faces an outer circumferential surface of the separation roller in a nip position between the separation surface and the outer circumferential surface, the separation pad being configured to separate the one or more sheets on a sheet-by-sheet basis in cooperation with the separation roller, the separation surface comprising:

a first surface disposed upstream relative to the nip position in the first direction, the first surface comprising a curved surface that is curved to become closer to the axis in a direction toward the nip position from an upstream end portion of the separation surface in the first direction; and a second surface disposed downstream relative to the nip position in the first direction, the second surface flatly extending along a second direction parallel to the axis; and an urging member configured to urge the separation pad in such a direction that the separation surface approaches the outer circumferential surface of the separation roller, the urging member being disposed in such a position as not to overlap the separation pad in a view in a third direction perpendicular to the first direction and the second direction.

10. The image reader according to claim 9, wherein the curved surface of the first surface is positioned closer to the axis than the second surface in a third direction perpendicular to the first direction and the second direction.

11. The image reader according to claim 9, further comprising a platen glass disposed to face the image reading unit, wherein the second surface extends substantially parallel to the platen glass.

12. The image reader according to claim 9, further comprising a supporter configured to support the separation pad, wherein the separation pad is a plate-shaped body having a constant thickness, and comprises a bonded surface opposite to the separation surface, and wherein the supporter comprises a supporting surface bonded with the bonded surface of the separation pad, the supporting surface being curved to become closer to the axis in the direction toward the nip position from an upstream end of the supporting surface in the first direction, within a range corresponding to the curved surface.

13. The image reader according to claim 9, further comprising a film extending downstream in the first direction, the film comprising:

an upstream end portion disposed upstream relative to the curved surface in the first direction; and a downstream end portion disposed downstream relative to the upstream end portion in the first direction, the downstream end portion being positioned to reach a position of the curved surface in the first direction.

14. The image reader according to claim 13, wherein the downstream end portion of the film is spaced apart from the curved surface in a third direction perpendicular to the first direction and the second direction.

15. The image reader according to claim 9, wherein the urging member is disposed in a position where at least a part of the urging member overlaps the separation pad in a view in the first direction.

16. The image reader according to claim 9, further comprising:

a supporter configured to support the separation pad, the supporter comprising a plate-shaped portion disposed upstream relative to the nip position in the first direction; and a leaf spring disposed in a position where an end portion of the leaf spring is positioned upstream relative to the curved surface in the first direction, the leaf spring extending downstream in the first direction and approaching the outer circumferential surface of the separation roller near the nip position, the leaf spring being formed to:

extend downstream in the first direction, along a surface of the plate-shaped portion that is opposite to a surface of the plate-shaped portion facing the outer circumferential surface of the separation roller;

thereafter bend; and thereafter protrude toward the outer circumferential surface of the separation roller from the plate-shaped portion.

* * * * *